US011076708B2

(12) United States Patent
Santicchi

(10) Patent No.: US 11,076,708 B2
(45) Date of Patent: Aug. 3, 2021

(54) APPARATUS FOR MOVING ARTICLES

(71) Applicant: Immobiliare Metalprogetti S.R.L., Perugia (IT)

(72) Inventor: Augusto Santicchi, San Sisto (IT)

(73) Assignee: Immobiliare Metalprogetti S.R.L.

( * ) Notice: Subject to any disclaimer, the term of this patent is extended or adjusted under 35 U.S.C. 154(b) by 0 days.

(21) Appl. No.: 16/645,109

(22) PCT Filed: Sep. 7, 2017

(86) PCT No.: PCT/IT2017/000187
§ 371 (c)(1),
(2) Date: Mar. 6, 2020

(87) PCT Pub. No.: WO2019/049179
PCT Pub. Date: Mar. 14, 2019

(65) Prior Publication Data
US 2020/0305614 A1 Oct. 1, 2020

(51) Int. Cl.
*A47F 5/02* (2006.01)
*A47G 25/06* (2006.01)
*A47F 5/025* (2006.01)
*A47B 61/00* (2006.01)

(52) U.S. Cl.
CPC ..... *A47F 5/025* (2013.01); *A47G 25/0664* (2013.01); *A47B 61/003* (2013.01)

(58) Field of Classification Search
CPC ..... A47F 5/025; A47F 5/02; A47G 25/0664; A47B 61/003; A47B 61/00
See application file for complete search history.

(56) References Cited

U.S. PATENT DOCUMENTS 1,598,925 A * 9/1926 Murphy ..... F21V 33/006 211/33
1,717,246 A * 6/1929 Perling ..... A47F 3/08 211/122
1,865,923 A * 7/1932 Krawitz ..... A47F 5/025 108/20
1,965,850 A * 7/1934 Melton ..... A47F 5/025 108/20

(Continued)

FOREIGN PATENT DOCUMENTS

CN 204838675 U 12/2015
CN 106264005 A 1/2017

(Continued)

OTHER PUBLICATIONS

International Search report and Written Opinion issued in PCT/IT2017/000187, dated Mar. 21, 2018.

(Continued)

*Primary Examiner* — Stanton L Krycinski
(74) *Attorney, Agent, or Firm* — BakerHostetler

(57) ABSTRACT

Apparatus for moving articles comprising a support panel (12) with a mainly flat development; a conveying member (13) associated with said support panel (12), with a closed-loop development and provided with a plurality of attachment portions (14) installed protruding with respect to a first surface (15) of said support panel (12); a drive member (16) associated with said first surface (15) of said support panel (12) and configured to move said conveying member (13) in a closed travel.

8 Claims, 4 Drawing Sheets

(56) References Cited

U.S. PATENT DOCUMENTS 1,984,343 A * 12/1934 Hines ..... A47F 5/025 108/94
2,275,749 A * 3/1942 Fisher ..... A47F 7/12 211/120
3,139,191 A * 6/1964 King ..... A47G 25/02 211/122
3,144,133 A * 8/1964 Doulos ..... A47F 5/025 211/1.53
3,160,231 A * 12/1964 Bacsanyi ..... A47F 5/025 185/40 R
3,252,581 A * 5/1966 Jenkins ..... A47F 5/025 211/1.52
3,756,455 A * 9/1973 Patrick ..... G07F 9/10 221/85
3,972,140 A * 8/1976 Casparro ..... G09F 11/12 40/470
3,997,059 A * 12/1976 Hanneman ..... A47B 61/003 211/1.53
4,742,924 A * 5/1988 Tarlow ..... B65G 37/005 211/121
5,474,187 A * 12/1995 Taylor ..... A47G 25/74 198/678.1
5,533,632 A * 7/1996 Patterson ..... A47F 5/025 198/678.1
6,609,773 B1 * 8/2003 Steadman ..... A47B 49/00 108/105
9,486,091 B2 * 11/2016 Joscher ..... A47F 5/0838
10,512,342 B2 * 12/2019 Santicchi ..... A47F 5/025
2013/0245808 A1 * 9/2013 Hexter ..... A47B 61/003 700/214

FOREIGN PATENT DOCUMENTS

DE 3510931 A1 10/1986
DE 3725723 A1 * 2/1989 ..... A47F 5/025
DE 8509025 U1 * 9/1993 ..... A47F 5/025
DE 202013104958 U1 * 11/2013 ..... A47G 25/0664
DE 202013104960 U1 * 11/2013 ..... A47G 25/0664
DE 202013104964 U1 * 11/2013 ..... A47G 25/0664
FR 1128278 A * 1/1957 ..... A47F 5/025
FR 77897 E * 5/1962 ..... A47F 5/025
FR 2995201 A3 * 3/2014 ..... A47G 25/0664
FR 2995202 A3 * 3/2014 ..... A47G 25/0664
GB 762204 A * 11/1956 ..... A47F 5/025

OTHER PUBLICATIONS

International Preliminary Report on Patentability and Written Opinion issued in PCT/IT2017/000187, dated Mar. 19, 2020.

* cited by examiner

APPARATUS FOR MOVING ARTICLES

CROSS-REFERENCE TO RELATED APPLICATIONS

This application is the National Stage of International Patent Application No. PCT/IT2017/000187, filed Sep. 7, 2017, the disclosure of which is incorporated herein by reference in its entirety.

FIELD OF THE INVENTION

The present invention concerns an apparatus for moving articles, such as garments.

In particular, the present invention can be used, merely by way of example, in the domestic field, in hotels or in businesses selling clothing, for the temporary or intermediate storage of articles or clothing.

BACKGROUND OF THE INVENTION

Various types of movement apparatuses are known, for the temporary storage and movement of articles in order to make them selectively removable by an operator or another subject in a desired position.

An apparatus for moving articles is known, for example, from document WO-A-2015/008173, which comprises a support panel with a substantially flat development and with which with a sliding guide a with closed-loop development is associated.

In the sliding guide, a conveyor belt is slidably installed, which is provided with a plurality of attachment portions, in this case, through apertures, to attach and support garments.

The part of the conveyor belt containing the attachment portions is installed protruding from the sliding guide and protruding with respect to a surface of the support panel.

On the same surface of the support panel, a drive member is installed that cooperates with the conveyor belt and determines the movement of the latter along the sliding guide.

A protective cover is associated with the surface of the support panel, protruding from it, and contains inside it the drive member to hide it from view and to provide a safety protection for the moving parts of the movement apparatus.

The protective cover is an essential component for this type of movement apparatus in order to ensure safety for users. However, the presence of a protective cover protruding from the surface where articles are normally installed is particularly anti-esthetic, for example compared to a fully linear and essential aesthetic conformation supplied by the support panel.

The support panel thus defined is installed cantilevered to define a shelf, or is part of a cabinet where it defines the upper part.

The particular conformation and disposition of the protective cover, in fact, defines a limit to how to install and support the support panel.

There is therefore a need to perfect the state of the art and make available a movement apparatus for articles that overcomes at least one of the disadvantages of the state of the art.

The purpose of the present invention is to obtain a movement apparatus which allows to increase its installation possibilities.

It is also a purpose of the present invention to obtain a movement apparatus whose aesthetic features are not conditioned by the presence of operational components.

It is also a purpose of the present invention to obtain a movement apparatus that meets safety requirements.

It is also a purpose of the present invention to obtain a movement apparatus that is modular.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, the present invention concerns an apparatus for moving articles that comprises:

a support panel with a mainly flat development, a conveying member associated with the support panel, with a closed-loop development and provided with a plurality of attachment portions installed protruding with respect to a first surface of the support panel;

a drive member associated with the first surface of the support panel and configured to move the conveying member in a closed travel.

According to one aspect of the present invention, the movement apparatus comprises at least a support base which can be positioned on a support surface, and a connecting body associated with the support base, connected to the first surface of the support panel and defining with the latter a containing compartment in which the drive member is contained and concealed from view.

In this way it is possible to obtain a movement apparatus able to support itself, that is, it can be positioned in any area whatsoever without needing to carry out complex installation operations. At the same time, the parts of the support plane used for support also have the function of containing the movement members inside them, and therefore provide a protective function.

This solution also allows to satisfy particular esthetic requirements of the movement apparatus, making it particularly suitable to display the articles.

The movement apparatus thus defined can also have a modular conformation, that is, it is possible to define a combination of two or more movement apparatuses as described above, wherein the support panel of a first movement apparatus has a second surface opposite its respective first surface and, during use, facing toward the other, and a second movement apparatus is positioned resting on the second surface of the first movement apparatus with its respective support base.

It is quite clear that such a conformation, according to the present invention, allows to obtain a completely modular structure in which two or more movement apparatuses can be located one on top of the other.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
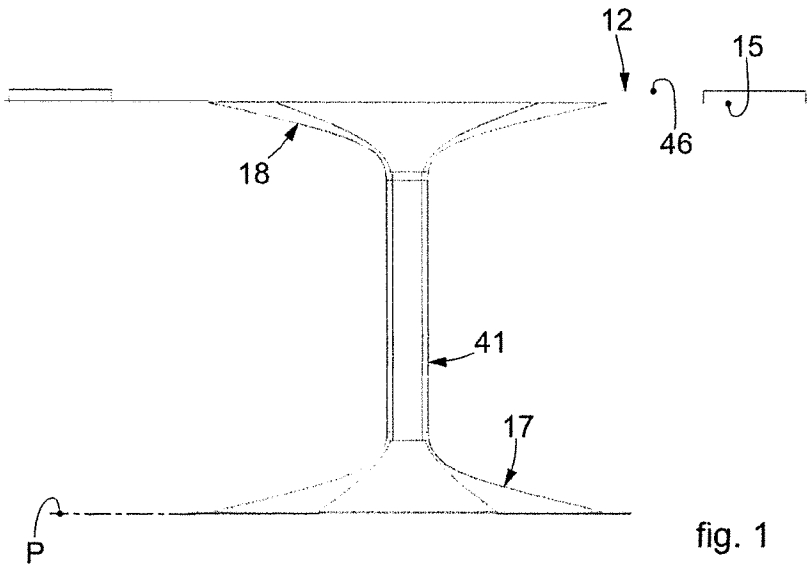
FIG. 1 is a front view of a movement apparatus for articles according to the present invention.

With reference to the attached drawings, which show non-restrictive examples of the invention, we will now describe some embodiments of a movement apparatus 10 for articles 11.

The movement apparatus 10 according to the present invention comprises at least:

a support panel 12 having a mainly flat development, a conveying member 13 associated with the support panel 12, having a closed-loop development and provided with a plurality of attachment portions 14 protruding with respect to a first surface 15 of the support panel 12;

a drive member 16 associated with the first surface 15 of the support panel 12 and configured to move the conveying member 13 along a closed path.

Furthermore, the movement apparatus 10 comprises at least one support base 17 which can be positioned on a support surface P, and a connecting body 18 associated with the support base 17, connected to the first surface 15 of the support panel 12 and defining with the latter a containing compartment 19 in which the drive member 16 is contained and concealed from view.

The support panel 12 can be defined by one or more plates, or sheets, for example metal, attached to each other to define its faces, and be hollow inside.

In other embodiments, the support panel 12 can have a solid or partly solid section, for example a drum structure made of wood or aluminum, or a composition of these two materials or others, such as for example glass, polymer materials, or derivatives or surrogates of wood, and have one or more internal cavities.

The external surfaces of the support panel 12 can be covered with covering materials such as fabrics, leather, imitation leather, non-woven fabrics or other materials suitable for the purpose, to give a desired aesthetic appearance.

The first surface 15 of the support panel 12 can have a mainly flat development.

According to possible embodiments, the conveying member 13 can be installed sliding on the first surface 15 of the support panel 12.

In other embodiments, the support panel 12 can also comprise a sliding guide 20 having a closed-loop conformation and in which the conveying member 13 is slidably installed.

The sliding guide 20 can be provided with a through aperture 21, which is made open toward the first surface 15 of the support panel 12 and through which at least part of the conveying member 13 is positioned protruding, with its attachment portions 14.

The through aperture 21 can have a slit configuration.

The articles 11 are, in fact, hung, or hooked, to the attachment portions 14 on the side of the support panel 12 facing the first surface 15.

The sliding guide 20 can be defined by a shaped section bar attached on the periphery, and defining the perimeter edge of the support panel 12.

According to variant embodiments, the sliding guide 20, or at least part of it, can be at least partly made in the thickness of the support panel 12.

The sliding guide 20 is provided with a sliding seating 23 in which part of the conveying member 13 is slidably positioned.

The sliding seating 23 is made open in correspondence with the through aperture 21.

The sliding seating 23 defines a closed movement path of the conveying member 13.

The closed path lies on a plane parallel to the first surface 15 of the support panel 12.

According to possible solutions of the invention, the conveying member 13 delimits, with its closed-loop development, a surface area 24 of the first surface 15 of the support panel 12. In this surface area 24 the drive member 16 is installed.

Advantageously, it is provided that the drive member 16 is installed centrally in the surface area 24 of the support panel 12, in order to allow to attach the connecting body 18 in a central zone of the support panel 12.

According to possible solutions, the conveying member 13 comprises at least one conveyor belt 25 and sliding elements 26 connected to the conveyor belt 25 and configured to facilitate the sliding of the conveyor belt 25 in the sliding guide 20.

The conveyor belt 25 can be defined by one or more plate-shaped elements, that is, laminar, which generally define a closed-loop configuration.

The conveyor belt 25 can be provided with the attachment portions 14.

The attachment portions 14 can be defined by eyelets made directly in the thickness of the conveyor belt 25.

According to a variant, the attachment portions 14 can be defined by one or more hooks attached to the conveyor belt 25.

The sliding elements 26 can be installed in the sliding seating 23 of the sliding guide 20 and can be selectively moved along the closed-loop path.

The sliding elements 26 can be associated with the conveyor belt 25 with one or more support sliders 27 disposed in the sliding seating 23.

The sliding elements 26 can comprise sliding rollers, installed free to rotate around their axes and cooperating with the sliding guide 20.

The conveying member 13 can comprise actuation devices 28 installed in the support panel 12 and selectively drivable by the drive member 16.

According to a possible embodiment of the invention, the support panel 12 can be provided with a housing seating 29 made open toward the first surface 15 and at least partly housing the actuation devices 28.

The actuation devices 28 are put in contact with the conveying member 13 and their actuation determines a movement along the closed-loop path.

According to a possible solution, the sliding guide 20 is provided with a slit 30 in which part of the actuation devices 28 is positioned through, to interact with the conveying member 13.

According to a possible solution, the actuation devices 28 can comprise at least one actuation wheel 31 connected to the drive member 16 in order to make it rotate.

The actuation wheel 31 is put in contact with the conveying member 13 to determine its drive.

The actuation wheel 31 can be provided with a toothing that, during use, cooperates with the sliding elements 26 and/or the support sliders 27 of the conveyor member 13.

According to a possible variant embodiment, not shown, the actuation devices can also comprise a contrast wheel laterally adjacent to the actuation wheel and between which the conveyor belt is made to pass. The reciprocal pressure and friction generated by the actuation wheel and the contrast wheel on the conveyor belt determine the movement of the latter.

The drive member 16 can be attached to the first surface 15 of the support panel 12 by means of a support plate 32.

The support plate 32 can close the housing seating 29 to keep the actuation wheel 31 in the latter.

In particular, the drive member 16 is installed protruding from the first surface 15 of the support panel 12.

The drive member 16 can comprise an electric motor 33 and at least one speed reducer 34.

The drive member 16 can also be provided with control and command devices 35 provided to command the actuation of the electric motor 33.

The drive member 16 is contained inside the connecting body 18.

The connecting body 18 can be defined by a shaped metal sheet so as to define a cavity 36 which, together with the first surface 15, defines the containing compartment 19.

The connecting body 18 can have a funnel shape with a cross-section that widens toward the first surface 15, in order to define the space necessary to contain the drive member 16.

According to a possible embodiment, the connecting body 18 can have an elongated shape in a direction parallel to the longitudinal extension of the support panel 12.

The connecting body 18 is provided with a first edge 37 lying on a plane, and is positioned resting on and attached to the first surface 15 of the support panel 12. The first edge 37 can be attached to the first surface 15 by connection elements such as threaded components, or by gluing.

The connecting body 18 can also be provided with a second edge 38, opposite to the first, and which connects, in this specific case, indirectly to the support base 17.

According to a possible embodiment, the cavity 36 of the connecting body 18 is through between the first edge 37 and the second edge 38.

According to a possible solution, the connecting body 18 is provided with at least one aperture 39 which can be selectively opened/closed by means of a covering element 40 and allowing access to the containing compartment 19.

According to a possible solution, the movement apparatus 10 according to the present invention comprises a connecting upright 41 installed between the support base 17 and the connecting body 18.

The connecting upright 41 allows to define the reciprocal distance between the support base 17 and the support surface 12, and therefore to define the height at which the latter is to be positioned with respect to the support surface P.

According to a possible variant of the present invention, not shown, the connecting upright 41 can be provided with means to adjust its length, to allow to adjust the positioning in height of the support plane 12.

The adjustment devices can comprise telescopic devices, linear adjustment mechanisms such as worm screws, racks, linear actuators or similar and comparable devices, suitable for the purpose.

According to a possible solution, the connecting upright 41 is provided with a through tubular cavity 42, which during use is put in communication with the containing compartment 19 and through which at least power elements 43 of the drive member 16 are positioned.

The power elements 43 can comprise, merely by way of example, electric conductor wires to provide at least power to the drive member 16. This allows to hide the power components from view and keep them in a non-interfering position with the movement of the articles 11.

According to possible solutions, the connecting upright 41 is connected to the connecting body 18 in correspondence with the second edge 38 of the latter.

Coupling joints, dedicated for the purpose, can be provided between the connecting upright 41 and the connecting body 18, or same-shape couplings can be made.

The support base 17 can have a substantially flat and widened shape.

The support base 17 can be positioned on a support surface P, such as the floor, or on a different surface as described hereafter.

Weights can be associated with the support base 17, to provide stability for the support plane 12 and the articles 11.

According to a possible solution, the support base 17 can be identical to the connecting body 18, that is, it can have the same shape and size. This allows to obtain a reduction in the number of components to be made, increases its ease of management and facilitates assembly operations.

According to a possible solution, the support base 17 can also be provided with a housing cavity, not visible in the drawings, which is put in communication with the containing compartment 19, possibly by means of the tubular cavity 42 of the connecting upright 41. Through the housing cavity, the power elements 43 of the drive member 16 can possibly be made to pass.

According to a possible solution, the movement apparatus 10 can comprise command devices 44 provided to command at least the actuation of the drive member 16 to move the conveying member 13 along the closed-loop path.

Figure 2:
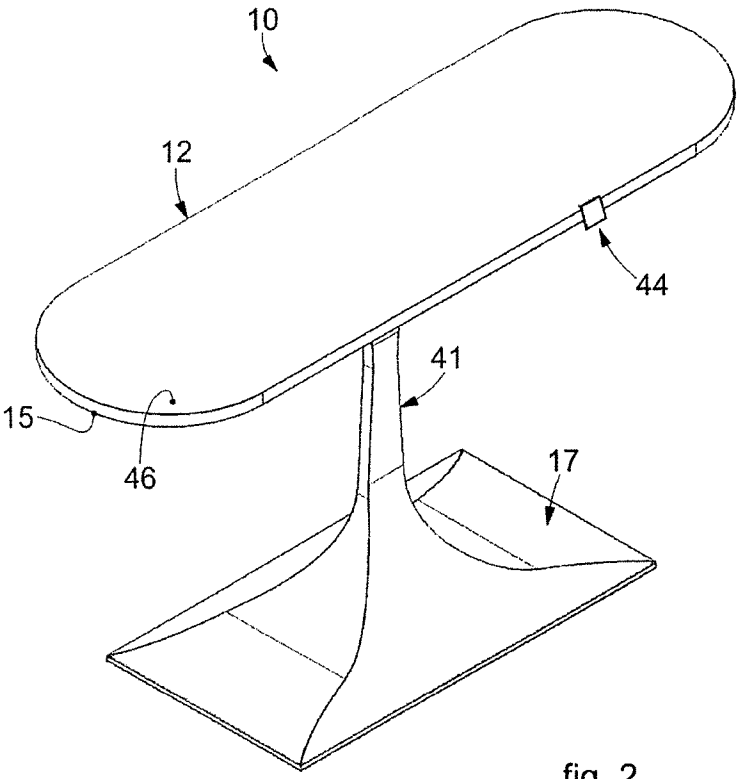
FIG. 2 is a perspective view of FIG. 1.
Figure 3:
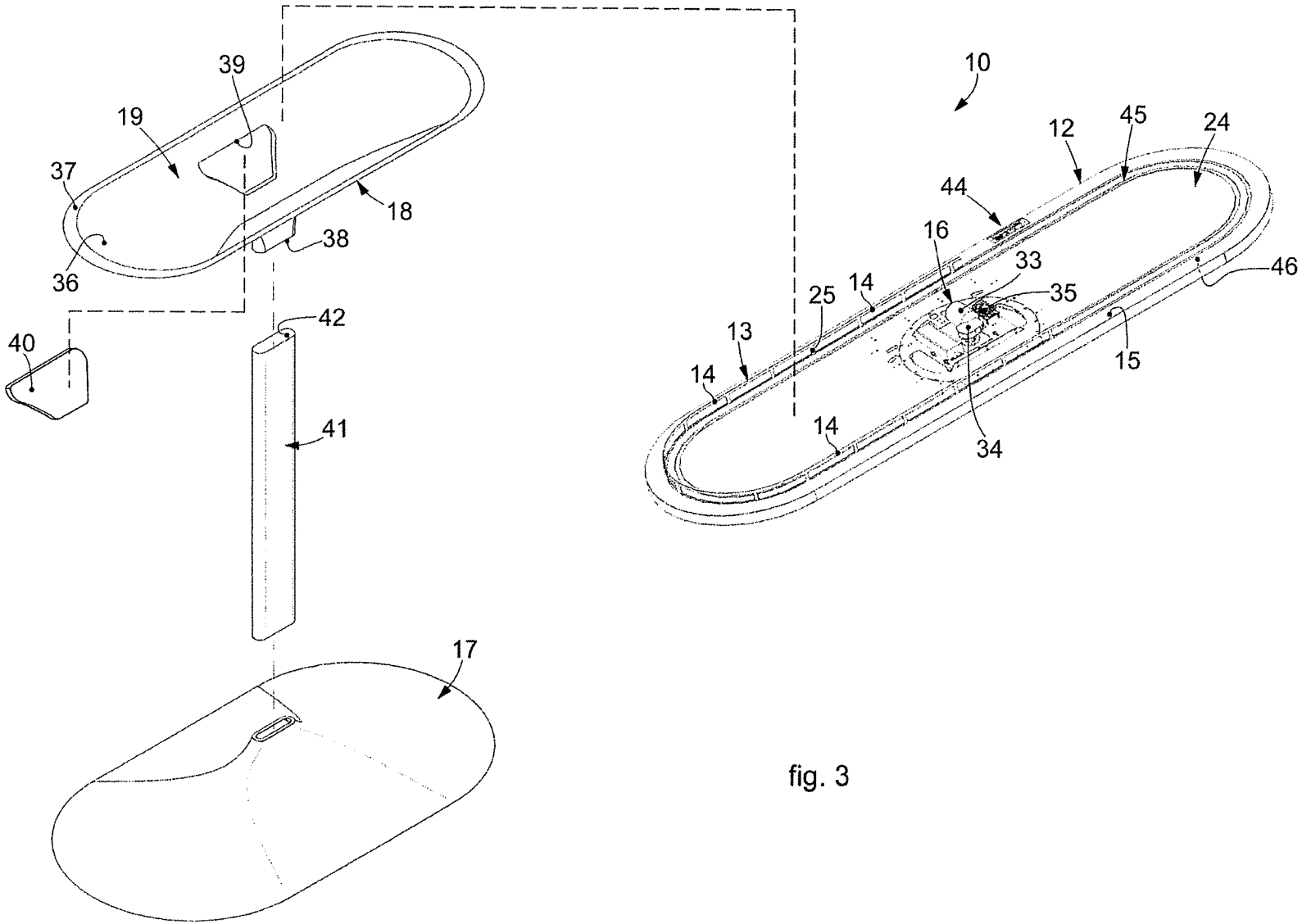
FIG. 3 is an exploded view of FIG. 1.
Figure 4:
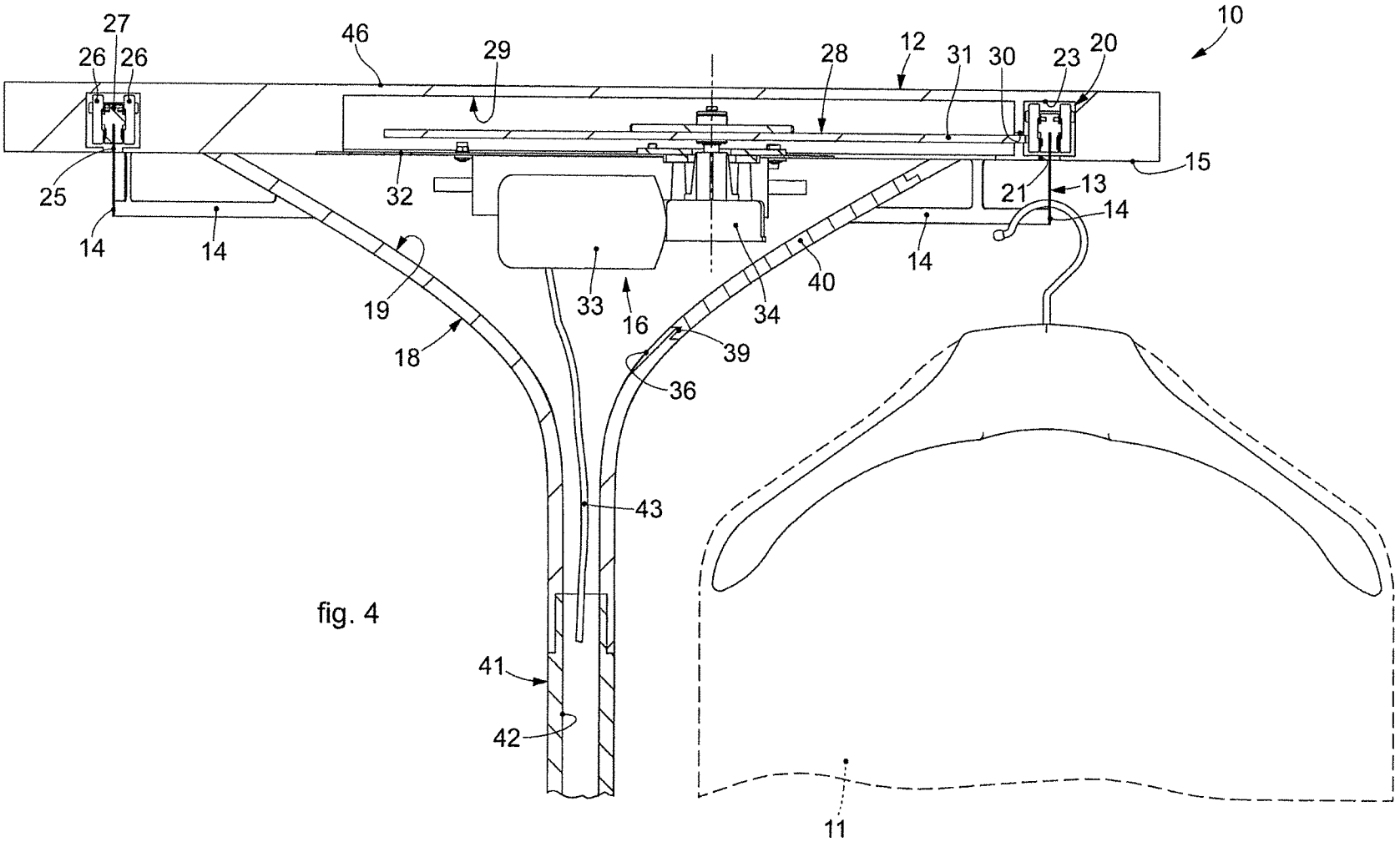
FIG. 4 is a section view of a part of a movement apparatus according to the present invention.

The command devices 44 can be installed in the support panel 12, for example in correspondence with a perimeter edge of the latter as shown in FIGS. 2 and 3.

Figure 5:
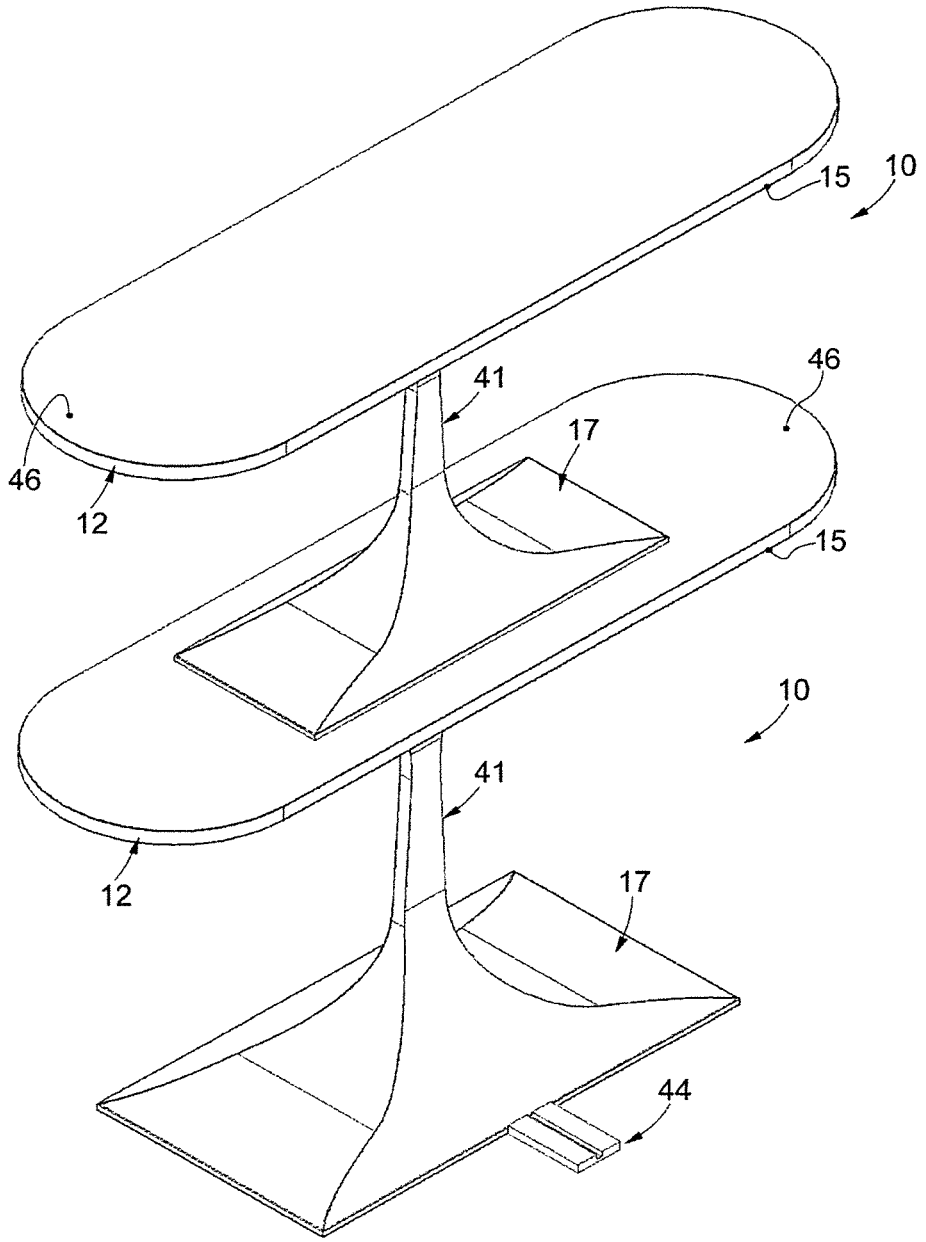
FIG. 5 is a schematic drawing of a combination of two movement apparatuses according to the present invention.

According to a variant embodiment (FIG. 5), the command devices 44 are associated with the support base 17 and allow to actuate the conveying member 13, for example by means of pressure exerted by a foot. In this embodiment, the command devices 44 can comprise pedal switches.

According to another variant embodiment, not shown, the command devices 44 can comprise a pedalboard with switches, separate from the support base 17 and selectively connectable, by cable or in wireless mode, to the drive member 16 to allow its selective actuation.

In this way, a user can command the movement of the conveying member 13, possibly in one direction and the other, even though he/she has his/her hands busy, for example because he/she is holding some articles to associate with the conveying member 13.

According to another variant embodiment, the support panel 12 can comprise lighting devices 45 that can be selectively activated, for example by means of the command devices 44, to illuminate specific zones of the movement apparatus 10.

According to a possible solution, the lighting devices 45 can be installed in the first surface 15 of the support panel 12. The lighting devices 45 can be defined by one or more LED lighting strips.

Embodiments of the present invention also concern a combination of two or more movement apparatuses 10 as described above.

In particular, the support panel 12 of the movement apparatuses 10 is also provided with a second surface 46, opposite the first surface and having a mainly flat development.

The second surface 46 faces upward, during use, while the first surface 15 faces downward.

In particular, a movement apparatus 10 according to the present invention can be positioned resting, with its respective support base 17, on the second surface 46 of a first movement apparatus 10.

The second surface 46 therefore defines a support surface for the second movement apparatus 10, while the floor P defines the support surface for the first movement apparatus 10.

The support base 17 of the second movement apparatus 10, that is, the one located above the first, can be attached to the support panel 12 of the first movement apparatus 10, for example by means of threaded connections.

The support base 17 of the second movement apparatus 10 can be smaller than that of the first movement apparatus 10, since it has primarily a supporting function, and to discharge the forces towards the latter.

According to this embodiment, the command devices 44 can be configured to drive both the first and the second movement apparatus 10.

It is clear that modifications and/or additions of parts can be made to the apparatus 10 for moving articles as described heretofore, without departing from the field and scope of the present invention.

It is also clear that, although the present invention has been described with reference to some specific examples, a person of skill in the art shall certainly be able to achieve many other equivalent forms of apparatus 10 for moving articles, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. An apparatus for moving articles (11) comprising:

a support panel (12) with a mainly flat development, a conveying member (13) associated with said support panel (12), with a closed-loop development and provided with a plurality of attachment portions (14) installed protruding with respect to a first surface (15) of said support panel (12);

a drive member (16) associated with said first surface (15) of said support panel (12) and configured to move said conveying member (13) along a closed travel;

at least a support base (17) which is configured to be positioned on a support surface (P, 46), and a connecting body (18) associated with said support base (17), connected to said first surface (15) of said support panel (12) and defining with the latter a containing compartment (19) in which said drive member (16) is contained and concealed from view, and a connecting upright (41) installed between said support base (17) and said connecting body (18), wherein said connecting upright (41) is provided with a tubular cavity (42), located, during use, in communication with said containing compartment (19), and through which at least feed elements (43) of said drive member (16) are positioned.

2. The apparatus as in claim 1, wherein said support base (17) and said connecting body (18) are equal in size.

3. The apparatus as in claim 1, wherein that said connecting body (18) is provided with at least an aperture (39) which can be selectively opened/closed by a cover element (40), to allow access to said containing compartment (19).

4. The apparatus as in claim 3, characterized in that said conveying member (13) delimits a surface area (24) of said first surface (15) of the support panel (12), and in that said drive member (16) is installed inside said surface area (24).

5. The apparatus as in claim 1, wherein said connecting body (18) has a funnel shape with a cross section that widens toward said first surface (15).

6. The apparatus as in claim 1, further comprising command devices (44) provided to command at least the actuation of said drive member (16) and move said conveying member (13) along said closed travel.

7. The apparatus as in claim 6, wherein said command devices (44) are associated with said support base (17) and comprises pedal switches.

8. A combination of two or more movement apparatuses (10), comprising:

a first movement apparatus (10) according to claim 1; and a second movement apparatus (10) according to claim 1, wherein the support panel (12) of the first movement apparatus (10) has a second surface (46) opposite the respective first surface (15), and, during use, turned upward, and in that a second movement apparatus (10) is positioned resting on said second surface (46) of the first movement apparatus (10) with the respective support base (17).

* * * * *